US011492233B2

(12) United States Patent
Hickel et al.

(10) Patent No.: US 11,492,233 B2
(45) Date of Patent: Nov. 8, 2022

(54) MODULAR SILLS FOR ELEVATORS AND METHODS OF ASSEMBLING THE SAME

(71) Applicant: Nationwide Architectural Metals, Inc., Hickory, NC (US)

(72) Inventors: Claudio R. Hickel, Taylorsville, NC (US); James P. Hickel, Taylorsville, NC (US)

(73) Assignee: Nationwide Architectural Metals, Inc., Hickory, NC (US)

( * ) Notice: Subject to any disclaimer, the term of this patent is extended or adjusted under 35 U.S.C. 154(b) by 0 days.

(21) Appl. No.: 17/525,462

(22) Filed: Nov. 12, 2021

(65) Prior Publication Data

US 2022/0144592 A1 May 12, 2022

Related U.S. Application Data

(60) Provisional application No. 63/112,894, filed on Nov. 12, 2020.

(51) Int. Cl.
*B66B 13/30* (2006.01)
*B66B 19/00* (2006.01)

(52) U.S. Cl.
CPC ..... *B66B 13/301* (2013.01); *B66B 19/007* (2013.01)

(58) Field of Classification Search
CPC ..... B66B 13/301; B66B 19/007
See application file for complete search history.

(56) References Cited

U.S. PATENT DOCUMENTS 1,715,188 A 5/1929 Bullock et al.
4,079,550 A 3/1978 Bursk et al.
5,561,955 A 10/1996 Frobosilo et al.
5,915,501 A * 6/1999 Lodi ..... B66B 13/301 187/333
6,938,380 B2 9/2005 Friedman et al.
(Continued)

FOREIGN PATENT DOCUMENTS

CN 102328867 1/2012
CN 108002191 A * 5/2018
(Continued)

OTHER PUBLICATIONS

International Search Report and Written Opinion for PCT/US2021/059175, dated Jan. 25, 2022, 8 pgs.

*Primary Examiner* — Diem M Tran
(74) *Attorney, Agent, or Firm* — Womble Bond Dickinson (US) LLP

(57) ABSTRACT

A modular sill assembly includes a top layer, a bottom layer, a first fastener, and a second fastener. The top layer includes a first top plate and a second top plate. The first and second top plates define a door channel therebetween. Each of the first and second top plates includes a top surface, a bottom surface, and a blind bore. The blind bore is defined in the bottom surface and extends towards the top surface. The blind bore is threaded. The bottom layer includes a first base plate that defines a through bore. The first fastener extends through the first base plate and is threadably received in the blind bore of the first top plate to secure the first top plate to the first base plate. The second fastener extends through the first base plate and is threadably received in the blind bore of the second top plate to secure the second top plate to the first base plate.

19 Claims, 5 Drawing Sheets

(56) References Cited

U.S. PATENT DOCUMENTS

| | | | |
|---|---|---|---|
| 9,873,595 | B2 | 1/2018 | Akin |
| 10,308,481 | B2 * | 6/2019 | Giorgioni ..... B66B 13/301 |
| 2017/0043980 | A1 | 2/2017 | Yamamoto et al. |

FOREIGN PATENT DOCUMENTS

| | | | |
|---|---|---|---|
| CN | 109131365 | A * | 1/2019 |
| CN | 111483472 | | 8/2020 |
| JP | 5319755 | | 12/1993 |
| JP | 2010208767 | | 9/2010 |
| JP | 2013245038 | | 12/2013 |

* cited by examiner

MODULAR SILLS FOR ELEVATORS AND METHODS OF ASSEMBLING THE SAME

BACKGROUND

1. Technical Field

The present disclosure relates to elevators, more specifically, to modular sills for elevators. A method for assembling modular elevator sills is also disclosed.

2. Discussion of Related Art

Elevators include a cab sill in the cab or car and a hoist sill at each landing or floor that the cab stops. These sills are generally formed of a single unitary piece of material that is held in place by one or more fasteners that are received in a base of the sill.

Most modern cab sills and hoist sills are manufactured in few standard sizes, styles, and finishes. However, when there is a need or desire for a non-standard cab sill or hoist sill, the non-standard cab sill or hoist still must be manufactured as a custom one-off piece. For example, when an old elevator is updated, the cab sill and the hoist sill for the old elevator may be outside of the specifications of modern elevators. In addition, in some installations, an end user may desire a sill having a custom size, style, or finish that does not fit within the standard sizes.

SUMMARY

These custom sills require custom design, engineering, and manufacturing. Specifically, once a custom sill is designed, the structure of the custom sill must be verified to comply with the structural and load requirements of the custom application. Once the structure is verified, the custom sills are manufactured from a single piece of material. As such, there is a significant amount of time to program the machine and to machine the custom sills from a single piece of material. In view of the foregoing, a custom sill requires significant time to design and to manufacture. Thus, custom sills have a cost significantly greater than the cost of standard sills. In addition, custom sills also take significantly longer to produce and require a longer lead time than standard sills. As such, the increased cost and/or lead time required for a custom sill dissuades from the use of a custom sill except when absolutely necessary.

For the reasons detailed above, there is a need for custom elevator sills that can be produced at a lower cost and with a lower lead time than traditional custom elevator sills.

In an embodiment of the present disclosure, a modular sill assembly includes a top layer, a bottom layer, a first fastener, and a second fastener. The top layer includes a first top plate and a second top plate. The first and second top plates define a door channel therebetween. Each of the first and second top plates includes a top surface, a bottom surface, and a blind bore. The blind bore is defined in the bottom surface and extends towards the top surface. The blind bore is threaded. The bottom layer includes a first base plate that defines a through bore. The first fastener extends through the first base plate and is threadably received in the blind bore of the first top plate to secure the first top plate to the first base plate. The second fastener extends through the first base plate and is threadably received in the blind bore of the second top plate to secure the second top plate to the first base plate.

In some embodiments, the modular sill assembly includes sill extension sections. The top layer and the bottom layer may form a central section that is disposed between the sill extension sections. The sill extension sections may be formed of different materials or construction of the central section.

In another embodiment of the present disclosure, a method of assembling a modular sill includes stacking a first top plate and a second top plate on a first base plate. The method also includes threadably coupling a first fastener in a first blind bore that is defined in a bottom surface of the first top plate with the first fastener passing through a first through bore defined in the first base plate to secure the first base plate to the first top plate. The method also includes threadably coupling a second fastener in a second blind bore that is defined in a bottom surface of the second top plate with the second fastener passing through a second through bore defined in the first base plate to secure the first base plate to the second top plate.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
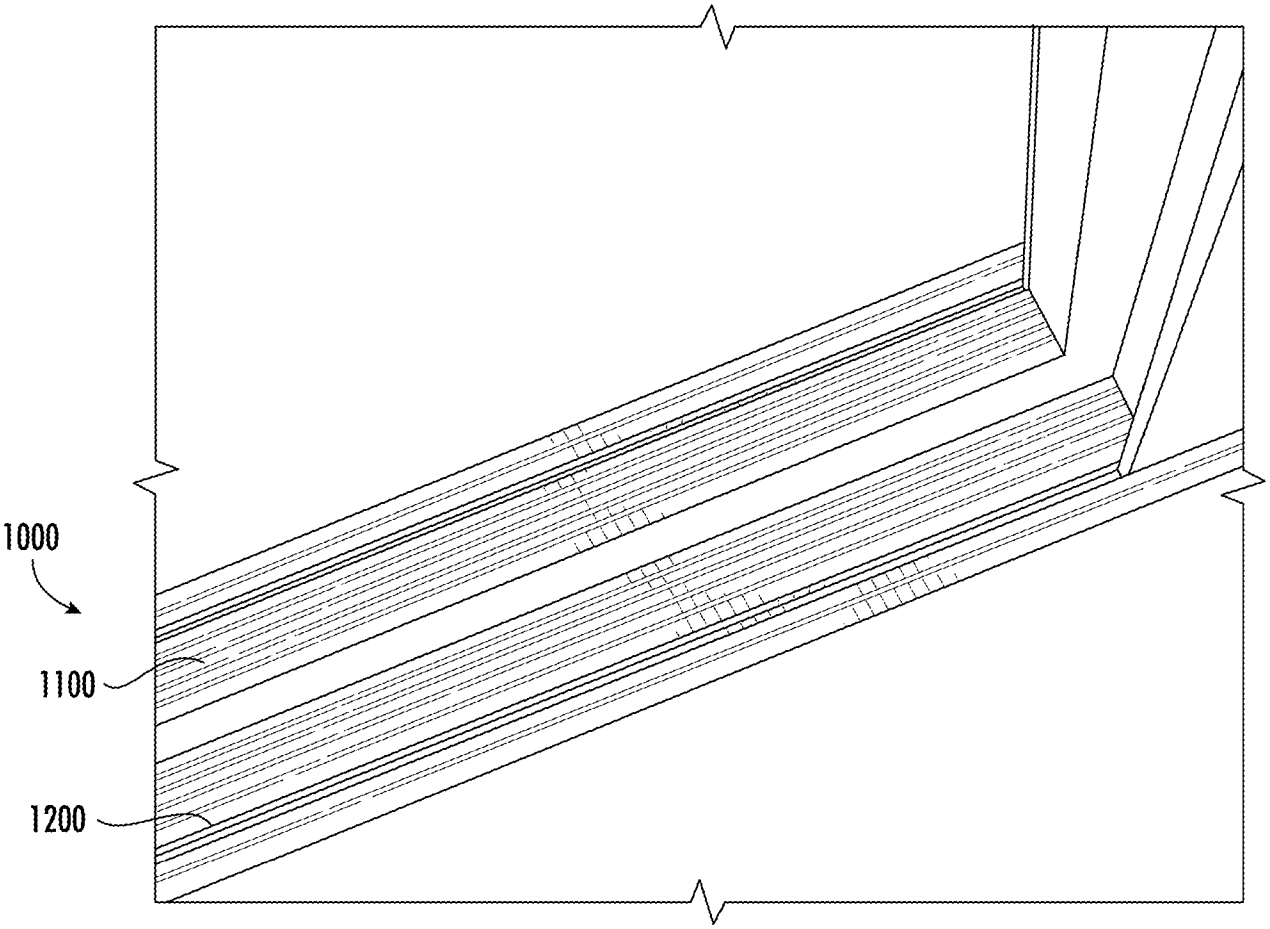
FIG. 1 is a perspective view of a prior art elevator sill assembly installed in an open elevator.

The present disclosure will now be described more fully hereinafter with reference to example embodiments thereof with reference to the drawings in which like reference numerals designate identical or corresponding layers in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

Briefly referring to FIG. 1, a prior art elevator sill assembly 1000 is shown and includes a hoist sill 1100 and a cab sill 1200. As shown, the hoist sill 1100 and the cab sill 1200 are each formed of a single piece of material. As shown, a hoist sill 1100 and the cab sill 1200 are elongated elements with a constant side profile.

Figure 2:
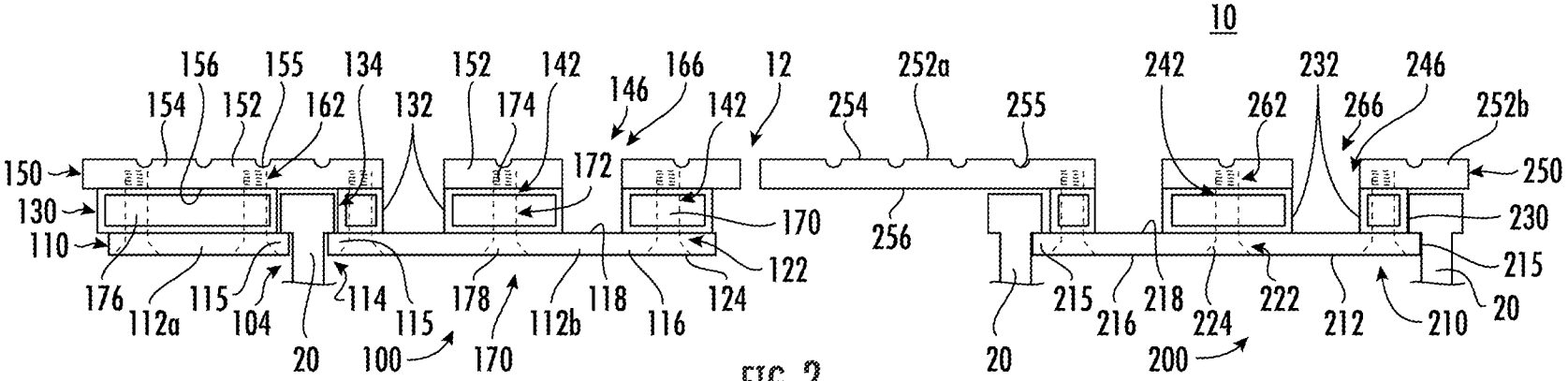
FIG. 2 is an end schematic view of an elevator sill assembly provided in accordance with an embodiment of the present disclosure.

Referring now to FIG. 2, an elevator sill assembly is provided in accordance with an embodiment of the present disclosure and is referred to generally as assembly 10. The assembly 10 includes a hoist sill 100 and a cab sill 200 with a gap 12 defined between the hoist sill 100 and the cab sill 200. The assembly 10 is shown from a side profile view with the understanding that the hoist sill 100 and the cab sill 200 may be formed in various lengths depending on the application. For example, the hoist sill 100 or the cab sill 200 may have a length in a range of 2 feet to 20 feet, e.g., 3 feet, 4 feet, 5 feet, 6 feet, 8 feet, or 10 feet.

The hoist sill 100 is configured to be secured on a floor or landing serviced by an elevator adjacent an elevator shaft. The hoist sill 100 may include one or more channels to receive a moveable door. In some embodiments, the hoist sill 100 may not include a channel, e.g., when the landing does not include a door separate from the door of the elevator cab. The cab sill 200 is configured to be secured in an elevator car or cab adjacent a side of the elevator cab that includes a moveable door. It will be appreciated that a single elevator cab may include more than one cab sill 200. For example, a single elevator cab may open on one side for a first floor and open on a second, opposite side for another floor such that the elevator cab may include a first cab sill adjacent the first side and a second cab sill adjacent the second side. The hoist sill 100 and the cab sill 200 are configured to protect a respective landing or entry from damage. In some embodiments, the hoist sill 100 or cab sill 200 may provide improved traction or grip compared to a surface adjacent the respective sill 100, 200. The gap 12 provides clearance between the hoist sill 100 and the cab sill 200 such that an elevator cab including the cab sill 200 is moveable relative to hoist sill 100.

The hoist sill 100 includes a base layer 110, a middle layer 130, a top layer 150, and a fastener 170 that secures the base layer 110, the middle layer 130, and the top layer 150 together. Specifically, the fastener 170 is threadably coupled to the top layer 150 such that the middle layer 130 is sandwiched between the top layer 150 and the base layer 110. In some embodiments, the middle layer 130 may be welded to the base layer 110 or the top layer 150.

Continuing to refer to FIG. 2, the base layer 110 may be a single base plate or may include a first or outer base plate 112*a* and a second or inner base plate 112*b*. In some embodiments, the base layer 110 may include more than two base plates. The base layer 110 may define a bottom portion 114 of a securement slot 104 that is receives a portion of a bolt, e.g., bolt 20, to secures the base layer 110 to a floor or landing and prevent the base layer 110 from lifting or slipping. As shown, the securement slot 104 is defined between the outer base plate 112*a* and the inner base plate 112*b* with each of the outer base plate 112*a* and the inner base plate 112*b* having a lip 115 that is engaged by a head of the bolt to prevent lifting or slipping of the hoist sill 110 after being installed. In some embodiments, the bolt 20 passes through the securement slot 104 to threadably couple to a nut (not shown) received within the slot 104 such that the nut engages the lips 115 to secure the hoist sill 100. It will be appreciated that the outer direction is a direction away from a cab of an elevator and that the inner direction is in a direction towards a cab of an elevator.

The base layer 110 includes a lower or bottom surface 116 and a top or upper surface 118 with a thickness of the base layer 110 defined between the bottom surface 116 and the top surface 118. The base layer 110 may have a thickness in a range of 0.125 inches to 0.5 inches, e.g., 0.1875 inches. In some embodiments, the base layer 110 may have a thickness greater than 0.5 inches.

The base layer 110 defines base bores 122 that pass through the thickness of the base layer 110. The base bores 122 include a counter sink 124 adjacent the bottom surface 116 such that a head of a fastener, e.g., fastener 170, that passes through the bottom surface 116 towards the top surface 118 can be received entirely above or flush with the bottom surface 116. The base bores 122 may be threaded or unthreaded.

The middle layer 130 is disposed between the base layer 110 and the top layer 150. The middle layer 130 provides support for the top layer 150 and contributes to an overall thickness of the hoist sill 100. The middle layer 130 is formed of one or more spacers 132. As shown, the spacers 132 are formed of rectangular tubing. For example, the spacers 132 may be formed of rectangular square tubing having a thickness in a range of 0.25 inches to 0.75 inches, e.g., 0.375 inches, and a width in a range of 0.25 inches to 3.5 inches, e.g. 0.75 inches. In some embodiments, the spacers 132 may be thicker than 0.75 inches and may have a width greater than 3.5 inches. The spacers 132 may have a wall thickness in a range of 10 gauge to 24 gauge, e.g., 12 gauge. In certain embodiments, the spacers 132 may be formed of solid bar stock.

The spacers 132 may define a top portion 134 of the securement slot 104. The top portion 134 may receive the head of a bolt and be is sized larger than the bottom portion 114 such that the head of the bolt engages lips 115 of the bottom portion 114 to retain the hoist sill 100.

The spacers 132 define through bores 142 that pass through the thickness of the spacers 132. Each of the through bores 142 aligns with one of the base bores 122 of the base layer 110 to allow a fastener, e.g., fastener 170, to pass through the base layer 110 and the middle layer 130. The through bores 142 may be unthreaded or threaded.

The spacers 132 define one or more door channels 146 between adjacent spacers 132. The door channels 146 may extend through the top layer 150 and the middle layer 130 such that the top surface 118 of the base layer 110 is exposed. The door channels 146 may have a width sized to allow a door to translate through the door channel 146 as the door opens and closes. As shown, the hoist sill 100 includes two door channels 146 such that the hoist sill 100 may be suitable for use with a double speed elevator door. In some embodiments, a hoist sill 100 may include a single door channel or may include more than two door channels. In some embodiments, the top surface 116 of the base layer 110 may be configured to support a portion of a door received within the door channel 146, e.g., a roller or wheel of the door.

The top layer 150 includes one or more top plates 152. The top plates 152 include an upper surface 154 that defines a top or exposed surface 104 of the hoist sill 100. The top plates 152 cover the spacers 132 and substantially cover the base plates 112, e.g., a portion of the base plates 112 may be exposed through the door channels 146. The upper surface 154 of the top plates 152 may include one or more grooves 155 or ribs (not shown) that are configured to provide traction or capture debris. In some embodiments, the grooves 155 or ribs may be patterned to include a design, e.g., aesthetic pattern, logo, or information.

The top plates 152 are configured to be exposed to traffic and loads in and out of the elevator cab including foot traffic, sliding loads, and wheeled loads including, but not limited to, carts, volleys, hand carts, forklifts, and vehicles depending on the application. As such, the material and design of the top plate 152 may depend greatly on the application. For example, a top plate of a hoist sill 100 for a passenger elevator may include a pattern or logo to be visually pleasing or to convey information to a person entering or exiting the elevator whereas a top plate of a hoist sill 100 for a freight elevator may be utilitarian and include a rib to prevent inadvertent rolling into or out of an elevator or a groove to capture debris.

The top plates 152 has a lower surface 156 and defines a thickness between the upper surface 154 and the lower surface 156. The thickness of the top plates 152 may be in a range of 0.1875 inches to 0.5 inches, e.g., 0.25 inches. The thickness of the top plates 152 may be dependent on the application of the hoist sill 100 with a greater thickness when the anticipated loads of on the top plates 152 is greater.

The top plates 152 also define blind bores 162 defined in the lower surface 156. The blind bores 162 are aligned with the through bores 142 of the spacers 132 and the base bores 122 of the base plates 110 such that a fastener may pass through the base plates 110 and into the top plates 152. The blind bores 162 are threaded to threadably couple to a fastener, e.g., fastener 170.

The top layer 150 further define one or more door channels 166 between adjacent top plates 152. The door channels 166 of the top layer 150 align with the door channels 146 of the spacers 132 to allow a door to slide therethrough as the doors open and close. The top layer 150 may define one or more door channels 146.

The hoist sill 100 is secured together by the fasteners 170 that pass through the base layer 110, through the middle layer 130, and into the top layer 150. The fasteners 170 include a shaft 172 that is sized to pass through the base bores 122 of the base layer 110, through the through bores 142 of the middle layer 130, and into the blind bores 162 of the top layer 150. The shaft 172 may include a threaded portion 174 that is sized to pass through the base layer 110 and the middle layer 130 and thread into the blind bore 162. The entire shaft 172 may define the threaded portion 174 or the shaft 172 may include a non-threaded shank 176 between the threaded portion 174 and a head 178 of the fastener 170. As detailed above, when the treaded portion 174 is threadably received in one of the blind bores 162, the head 178 of the fastener 170 engages a base plate 112 to sandwich the spacers 132 between the base layer 110 and the top layer 150. The fastener 170 may be a #10-32 machine screw.

The base plates 112 of the base layer 110 may be formed of stainless steel, structural steel, brass, aluminum, or plastics such as a thermoplastic or thermoset plastic. The spacers 132 of the middle layer 130 may be formed of stainless steel, structural steel, brass, aluminum, or plastics such as a thermoplastic or thermoset plastic. The top plates 152 may be formed of stainless steel, structural steel, brass, aluminum, or plastics such as a thermoset plastic. The top plates 152 may include a combination of materials. For example, the top plates 152 may include inlays of distinct materials or layers to provide visual distinctions or patterns.

The cab sill 200 is similar to the hoist sill 100, as such, only the differences between the cab sill 200 and the hoist sill 100 will be detailed herein for brevity. The like elements of the cab sill 200 will not be detailed herein and are identified with a similar label to the like elements of the hoist sill 100 replacing the preceding "1" with a preceding "2". For example, the cab sill 200 has a base layer 210, a middle layer 230, and a top layer 250 that are similar to the base layer 110, the middle layer 130, and the top layer 150 of the hoist sill, respectively.

The base layer 210 of the cab sill 200 may include a single base plate 212 that includes lips 215 on either end thereof. The lips 215 may each receive a portion of a bolt or may be received in a groove, channel, or slot of defined by the cab to secure the base layer 210 in the cab.

The top layer 250 of the cab sill 200 covers spacers 232 of the middle layer 230 and may extend beyond the ends of the middle layer 230 and the base layer 210. For example, a top plate 252*a* of the top layer 250 may be supported at one end portion by a spacer 232 and extend from the one end portion towards the hoist sill 100 such that the top plate 252*a* is cantilevered relative to the rest of the cab sill 200. Similarly, another top plate 252*b* of the top layer 250 may be supported at one end portion by another spacer 232 and extend from the one end portion away from the hoist sill 100 such that the top plate 252*b* is cantilevered relative to the rest of the cab sill 200.

As shown above, the elevator sill assembly 10 includes a hoist sill 100 and a cab sill 200. It will be appreciated that the hoist sill 100 or the cab sill 200 may be referred to as an elevator sill and may be used as a stand-alone element or as a replacement to a traditional elevator sill. In addition, it will be appreciated that a single elevator shaft may include a single cab sill for an elevator cab and multiple hoist sills with one hoist sill for each floor that the elevator cab stops.

Figure 3:
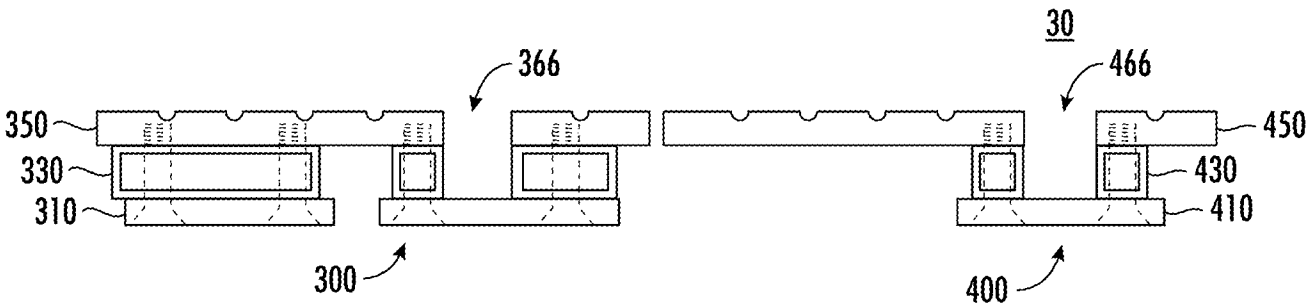
FIG. 3 is an end schematic view of another elevator sill assembly provided in accordance with an embodiment of the present disclosure.

The hoist sill 100 and the cab sill 200 shown in FIG. 2 are designed as double speed sills with two door channels, e.g., door channels 166, 266. With reference to FIG. 3, an elevator sill assembly 30 is provided in accordance with an embodiment of the present disclosure and includes a hoist sill 300 and a cab sill 400. The hoist sill 300 and the cab sill 400 are designed as single speed sill with a single door channel, e.g., door channels 366, 466.

Figure 4:
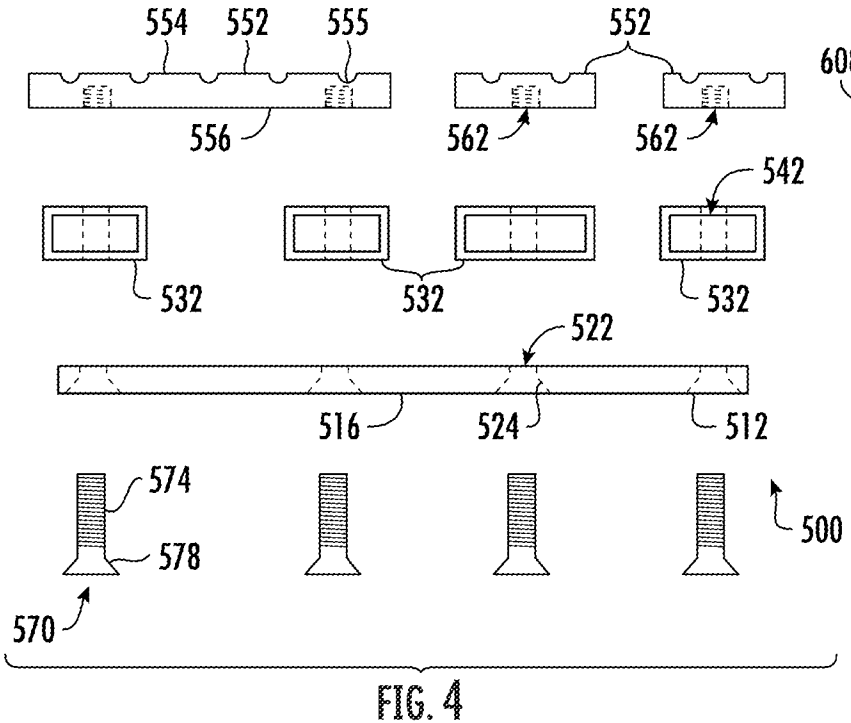
FIG. 4 is an end exploded schematic view of a cab sill provided in accordance with an embodiment of the present disclosure.
Figure 5:
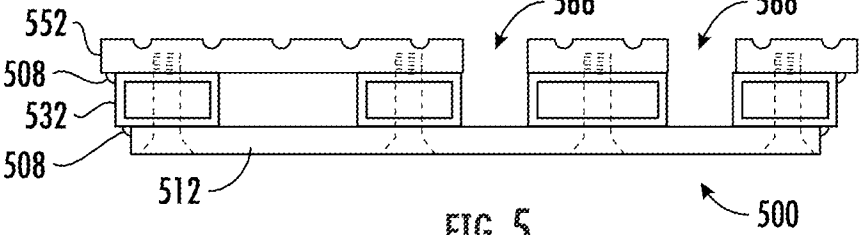
FIG. 5 is an end schematic view of the cab sill of FIG. 4.

Referring now to FIGS. 4 and 5, a method of manufacturing and assembling an elevator sill assembly is described in accordance with an embodiment of the present disclosure and is referred to generally as method 40. The method 40 will be described with reference to the cab sill 500 of FIGS.

4 and 5. The cab sill 500 is similar to the hoist sill 100 with like elements labeled with a preceding "5" replacing the preceding "1" of the hoist sill 100.

The method 40 includes manufacturing each piece or element of the cab sill 500. To manufacture the base plates 512, a solid plate of material is selected to have a desired thickness. The solid plate of material may also be selected with a width equal to or slightly greater than a desired width of the base plate. The solid plate of material may be cut to a desired width if the selected plate has a width greater than a desired with of the base plate 512. In certain embodiments, the thickness of the selected plate may be reduced until the selected plate has a desired thickness of the base plate 512. The selected plate may also be cut to a desired length of the base plate 512. When the base plate 512 has a desired thickness, width, and length, the through bores 522 are created in the base plate 512 with the counter sink 524 facing a bottom surface 516 of the base plate 512.

The spacers 532 are manufactured from rectangular tubes or bar stock depending on the application. To produce the spacers 532 rectangular tubes or bar stock are selected for each of the spacers 532 based on a desired thickness, width, and wall thickness for the particular application. As shown, the spacers 532 each have the same thickness and wall thickness but the width of the spacers 532 may vary depending on the location in the assembly 30. In some embodiments, the thickness of one or more of the spacers 532 may be different than the thickness of one or more of the other spacers 532 of the same assembly 30. In certain embodiments, the wall thickness of one or more of the spacers 532 may be different than the wall thickness of one or more of the other spacers 532 of the same assembly 30. With the tubes or bar stock selected for the spacers 532, the tubes or bar stock are cut to a desired length of the spacers 532. When the spacers 532 are cut to length, the through bores 542 are made through the spacers 532.

To manufacture the top plates 552, a solid plate of material is selected to have a desired thickness. The solid plate of material may also be selected with a width equal to or slightly greater than a desired width of the top plate. The solid plate of material may be cut to a desired width if the selected plate has a width greater than a desired with of the top plates 552. In certain embodiments, the thickness of the selected plate may be reduced until the selected plate has a desired thickness of the top plates 552. The selected plate may also be cut to a desired length of the top plates 552. When the top plates 552 has a desired thickness, width, and length, the through bores 522 are created in the base plate 512 with the counter sink 524 facing a bottom surface 516 of the base plate 512. In some embodiments, the thickness of one or more of the top plates 552 may be different than the thickness of one or more of the other top plates 552 of the same assembly 30. In certain embodiments, the wall thickness of one or more of the top plates 552 may be different than the wall thickness of one or more of the other top plates 552 of the same assembly 30. When the top plates 552 are cut to length, the blind bores 562 may be into the bottom surface 556 of the top plates 552. The blind bores 562 are then threaded in a manner to complement the threads of the fasteners 570.

As noted above, the top plates 552 may include grooves 555 or ribs. The grooves 555 may be machined into the top surface 554 of the top plates 552. In some embodiments, the grooves 555 or ribs are nonlinear and may include designs to improve the aesthetics of the top surface 554 of the top plates 552. In certain embodiments, the top surface 554 may include a logo to identify a manufacturer or a business associated with the elevator, floor, or building. In particular embodiments, the top surface 554 may include an inlay of materials distinct from the rest of the material of the top plate 552. In some embodiments, the profile of the top plates 552 is produced by a die such that the top plate 552 may be formed by being extruded through the die and then be cut to a desired length.

With the base plates 512, spacers 532, and top plates 552 formed, fasteners 570 are selected such that a head 578 of the fastener 570 complements and fits within the counter sink 524 of the base plates 512. The fastener 570 is also selected to have a length sufficient to pass through the through bores 522, 542 and into the blind bore 562 with the head 578 engaging the base plate 512. In addition, the threaded portion 574 of the fasteners 570 is selected to complement the threads of the blind bores 562.

With the fasteners 570 selected, the top plates 552, spacers 532, and base plates 512 are stacked in a desired configuration to form the door channels and securement slots. With the top plates 552, spacers 532, and base plates 512 stacked the through bores 522, 542 and blind bores 562 are aligned with one another. With bores 522, 542, 562 aligned, the fasteners 570 are passed through bores 522, 542, 562 and tightened to secure the top plates 522, spacers 532, and base plates 512 together to form a single integral sill 500. In certain embodiments, the top plates 522, spacers 532, and base plates 512 may be stacked before the bores 522, 542, 562 are created and the bores 522, 542, 562 may be created and threaded when stacked and then the fasteners 570 may be threaded into the bores 522, 542, 562. In some embodiments, when the fasteners 570 are threaded into the bores 522, 542, 562 to secure the sill 500 together, one or more of the spacers 532 may be welded along the edges 508 to one or more of the top plates 552 or base plates 512. The welded edges 508 may provide additional strength and support for the sill 500.

The method of manufacturing and assembling the cab sill 500 detailed above is a modular system that allows for customization of an individual elevator sill without extensive machine setup and programming. In addition, individual custom elements of the sill 500 may be useable in multiple different sill designs. For example, plate material, tube stock, or bar stock may be suitable for multiple custom sill designs. Such a method of assembly and a modular sill 500 allows for reduced inventory to make a wide range of custom or standard sills. In addition, a single sill may be produced at a reduced time compared to a custom sill formed of a single unitary piece.

In some embodiments, the top plate, e.g., top plate 552, may be replaceable when damaged. Specifically, the top plate 552 exposed to foot, wheel, or other traffic and may become damaged, worn, or marked in a manner that a replacing the top plate 552 is desirable. The modular design of the sills detailed herein, e.g., sill 500, allows for the removal and replacement of a single top plate 552 without the replacement of an entire sill 500. In addition, this removal and replacement may be accomplished on-site with standard tools, e.g., without a requirement for special tooling. This replicability may extend the life of sill and reduce a cost of ownership and maintenance of a sill.

Figure 6:
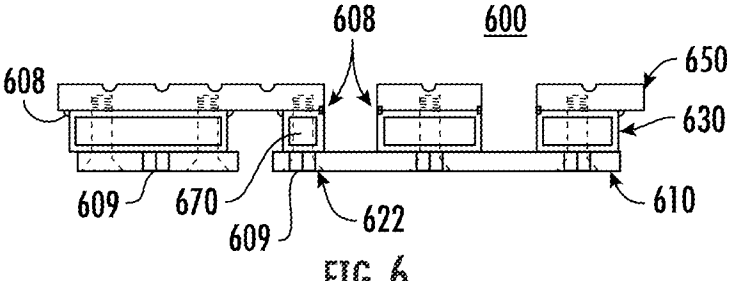
FIG. 6 is an end schematic view of a hoist sill provided in accordance with an embodiment of the present disclosure.

Referring now to FIG. 6, another hoist sill 600 is provided in accordance with an embodiment of the present disclosure. The hoist sill 600 is similar to the hoist sill 100 detailed above with like elements labeled with a preceding "6" replacing the preceding "1" of the hoist sill 100. The hoist sill 600 is assembled in a manner similar to the hoist sill 100 and includes several welded edges 608 between the middle layer 630 and the top layer 650. The base layer 610 may include welds 609 to secure the fasteners 670 within the bores 622. The welds 609 may prevent the fasteners 670 from rotating relative to the base layer 610.

Figure 7:
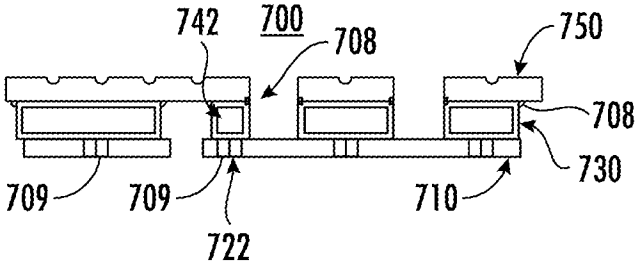
FIG. 7 is an end schematic view of another hoist sill provided in accordance with an embodiment of the present disclosure.

Referring now to FIG. 7, another hoist sill 700 is provided in accordance with an embodiment of the present disclosure. The hoist sill 700 is similar to the hoist sill 100 detailed above with like elements labeled with a preceding "7" replacing the preceding "1" of the hoist sill 100. The hoist sill 700 is assembled in a manner similar to the hoist sill 100 and includes several welded edges 708 between the middle layer 730 and the top layer 750. As shown, the hoist sill 700 does not include fasteners, e.g., fasteners 170 (FIG. 2), with the base layer 710 secured to the middle layer 730 by welds 709. The welds 709 may include filler material that fills the bores 722, 742.

In some embodiments, a hoist sill or cab sill consist of a top layer and a base layer. Specifically, such a hoist sill or cab sill would be provided without a middle layer such that the bottom layer is secured directly to the top layer. As such, the top layer and the base layer may be secured together with fasteners or be welded together.

Figure 8:
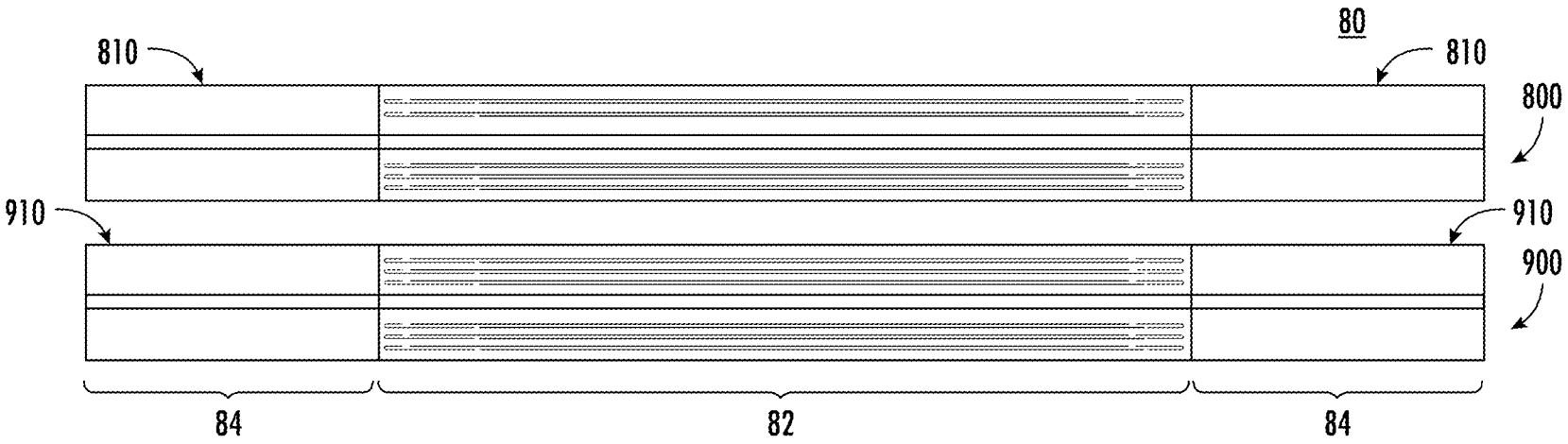
FIG. 8 is a top view of another elevator sill assembly provided in accordance with an embodiment of the present disclosure.

With reference to FIG. 8, an elevator sill assembly 80 is provided in accordance with the present disclosure and includes a cab sill 800 and a hoist sill 900. The elevator sill assembly 80 includes a central of visible section 82 and extension or hidden sections 84 on either side of the central section 82. The central section 82 may be similar to the elevator sill assemblies 10, 30, the cab sill 500, the hoist sill 600, or the hoist sill 700 detailed above and configured to be exposed or visible to a user of the elevator associated with the elevator sill assembly 80. The central section 82 may be visible when doors of a hoist or a cab are closed and are visible when doors of a hoist or a cab are open. The central section 82 may include a decorative pattern or design in the cab sill 800 or the hoist sill 900.

The extension sections 84 are disposed on either end of the central section 82. The extension sections 84 are configured to be hidden by a hoist door or a cab door associated with the elevator sill assembly 80. The extension sections 84 may be hidden when the associated hoist door or cab door are in the open and/or closed positions. The extension sections 84 have a similar cross-section to the central section 82 and are formed of different materials and constructions. The different materials and constructions of the extensions may reduce the cost of the elevator sill assembly 80 compared to the elevator sill assemblies having a continuous central section. Specifically, an elevator sill assembly having a continuous central section may have a top plate, e.g., top plate 552, that is formed of an expensive material such as brass, a reinforced structure to take heavy loads, or may include functional or decorative elements, e.g., ridges, grooves, or patterns along the entire length of the elevator sill assembly. In contrast, the elevator sill assembly 80 includes the central section 82 that is visible to users that looks and functions in a similar manner to a continuous sill assembly and uses a less expensive material and/or construction in the extension sections 84 that are not visible or are not contacted by users of the elevator sill assembly 80. Using a less expensive material and/or construction in the extension sections 84 may reduce an overall cost of the elevator sill assembly 80 relative to a continuous elevator sill assembly.

As shown, the elevator sill assembly 80 is eight feet long with the central section 82 being 5 feet long and each extension section 84 being 1.5 feet long. However, the specific dimensions of the length of the central section each of the extension sections may vary based on the specific application of the elevator sill assembly.

Figure 9:
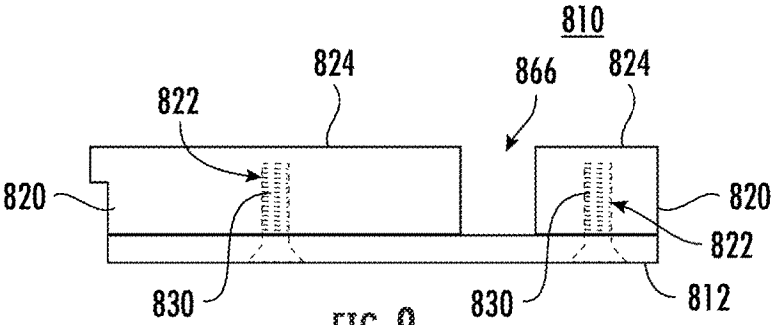
FIG. 9 is an end schematic view of a cab sill extension section in accordance with an embodiment of the present disclosure.

Referring now to FIG. 9, a single speed cab sill extension section 810 is provided in accordance with the present disclosure. The cab sill extension section 810 includes a base plate 812 and a top plate 820 that are secured together by fasteners 830. The fasteners 830 pass through the base plate 812 into blind bores 822 in the top plate 820 to secure the base plate 812 to the top plate 820. The top plate 820 includes a top surface 824. The top surface 824 may be substantially flat or lacking in features such as grooves or ribs. The single speed cab sill extension section 810 includes a single channel 866 for the passage of a cab door.

The base plate 812 may be formed of stainless steel. The base plate 812 of the extension section 810 may be monolithically formed with a base plate of the central section 82 or may be formed separate from the base plate of the central section 82. The top plate 820 may be formed of a material that is relatively low cost. In some embodiments, the top plate 820 may be formed of a material that is easy or inexpensive to machine. In certain embodiments, the top plate 820 is formed of aluminum. In particular embodiments, the top plate 820 may be formed of a single or solid piece of aluminum that is extruded and/or machined to form the top plate 820.

Figure 10:
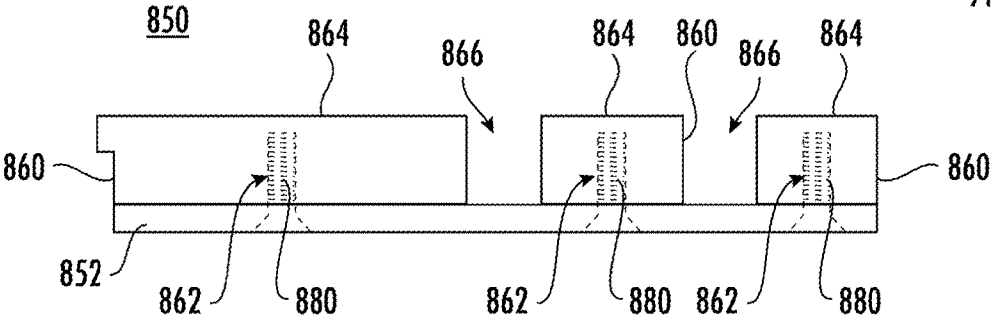
FIG. 10 is an end schematic view of a cab sill extension section in accordance with an embodiment of the present disclosure.

With reference to FIG. 10, a double speed cab sill extension section 850 is provided in accordance with the present disclosure. The double speed cab sill extension section 850 is similar to the single speed cab sill extension section 810 and includes a base plate 852 and a top plate 860 that are secured together with fasteners 870 that pass through the base plate 852. The double speed cab sill extension section 850 includes two channels 866 for the passage of a cab door.

Figure 11:
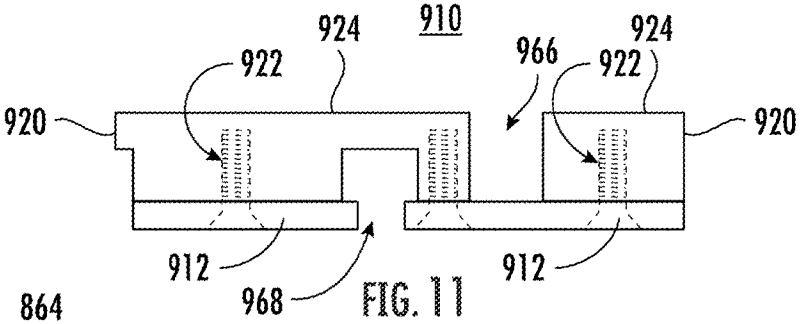
FIG. 11 is an end schematic view of a hoist sill extension section in accordance with an embodiment of the present disclosure.

Referring now to FIG. 11, a single speed hoist sill extension section 910 is provided in accordance with the present disclosure. The hoist sill extension section 910 includes a base plate 912 and a top plate 920 that are secured together by fasteners 930. The fasteners 930 pass through the base plate 912 into blind bores 922 in the top plate 920 to secure the base plate 912 to the top plate 920. The top plate 920 includes a top surface 924. The top surface 924 may be substantially flat or lacking in features such as grooves or ribs. The single speed cab sill extension section 910 includes a single channel 966 for the passage of a hoist door and a slot 966 to receive a fastener to secure the base plate 912.

The base plate 912 may be formed of stainless steel. The base plate 912 of the extension section 910 may be monolithically formed with a base plate of the central section 82 or may be formed separate from the base plate of the central section 82. The top plate 920 may be formed of a material that is relatively low cost. In some embodiments, the top plate 920 may be formed of a material that is easy or inexpensive to machine. In certain embodiments, the top plate 920 is formed of aluminum.

Figure 12:
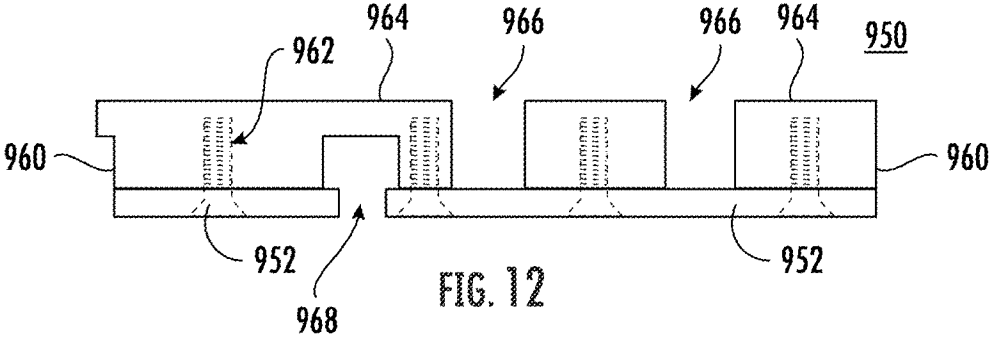
FIG. 12 is an end schematic view of a hoist sill extension section in accordance with an embodiment of the present disclosure.

With reference to FIG. 12, a double speed hoist sill extension section 950 is provided in accordance with the present disclosure. The double speed hoist sill extension section 950 is similar to the single speed hoist sill extension section 910 and includes a base plate 952 and a top plate 960 that are secured together with fasteners 970 that pass through the base plate 952. The double speed cab sill extension section 950 includes two channels 966 for the passage of a cab door.

As noted above, the use of extension sections that are not visible or used to load or unload a cab may reduce the cost of a cab sill, a hoist sill, or an elevator sill assembly compared to a similar cab sill, hoist sill, or elevator sill assembly without extension sections. Using the extension sections for a portion of a cab sill, a hoist sill, or an elevator sill assembly may reduce machining time required to produce a sill assembly.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A modular sill assembly comprising:

a top layer including a first top plate and a second top plate, the first and second top plates define a door channel therebetween, each of the first and second top plates including:

a top surface;

a bottom surface; and a blind bore defined in the bottom surface and extending towards the top surface, the blind bore being threaded;

a bottom layer including a first base plate, the first base plate defining a through bore; and a first fastener extending through the first base plate and threadably received in the blind bore of the first top plate to secure the first top plate to the first base plate; and a second fastener extending through the first base plate and threadably received in the blind bore of the second top plate to secure the second top plate to the first base plate.

2. The modular sill assembly according to claim 1, further comprising:

a first spacer including a through bore define therethrough, the first spacer sandwiched between the first base plate and the first top plate, the first fastener passing through the through bore of the first spacer; and a second spacer including a through bore define therethrough, the second spacer sandwiched between the first base plate and the second top plate, the second fastener passing through the through bore of the second spacer.

3. The modular sill assembly according to claim 2, wherein the first spacer is welded to the first top plate or the first base plate.

4. The modular sill assembly according to claim 1, wherein the bottom layer includes a second base plate, the first base plate and the second base plate defining a securement slot therebetween, the securement slot configured to receive a bolt to secure the bottom layer in position.

5. The modular sill assembly according to claim 1, further comprising sill extension sections, the top layer and the bottom layer forming a central section disposed between the sill extension sections, the sill extension sections being formed of different materials or construction of the central section.

6. The modular sill assembly according to claim 5, wherein the sill extension sections are configured to be disposed underneath a door when a door associated with the modular sill assembly is in an open position and the central section is configured to be exposed when the door associated with the modular sill assembly is in the open position.

7. The modular sill assembly according to claim 5, wherein the sill extension sections include a base plate and a top plate that are secured together by a fastener passing through the base plate.

8. The modular sill assembly according to claim 7, wherein the base plate of the sill extension sections are monolithically formed with the first base plate of the central section.

9. The modular sill assembly according to claim 7, wherein the top plate of the sill extension sections are formed of aluminum.

10. The modular sill assembly according to claim 7, wherein a top surface of the top plate of the sill extension is flat.

11. A method of assembling a modular sill, the method comprising:

stacking a first top plate and a second top plate on a first base plate;

threadably coupling a first fastener in a first blind bore defined in a bottom surface of the first top plate with the first fastener passing through a first through bore defined in the first base plate to secure the first base plate to the first top plate; and threadably coupling a second fastener in a second blind bore defined in a bottom surface of the second top plate with the second fastener passing through a second through bore defined in the first base plate to secure the first base plate to the second top plate.

12. The method according to claim 11, wherein threadably coupling the first fastener in the first blind bore includes passing the first fastener through a first spacer sandwiched between the first base plate and the first top plate.

13. The method according to claim 11, further comprising welding the first spacer to the first base plate or the first top plate.

14. The method according to claim 11, further comprising assembling a first sill extension section on a first end of the first top plate and a second sill extension section on a second end of the first top plate, the second end being opposite the first end.

15. The method according to claim 14, wherein assembling the first sill extension section and the second sill extension section comprises:

passing a fastener through a base plate of the respective sill extension section into an extension top plate of the respective sill extension section, the extension top plate having a different construction of formed of a different material from the first top plate.

16. The method according to claim 15, wherein passing the fastener through the base plate of the respective sill extension section includes passing the fastener through the extension base plate being monolithically formed with the first base plate.

17. The method according to claim 14, wherein assembling the first sill extension section and the second sill extension section includes sizing the first sill extension section and the second sill extension section to be disposed underneath a door associated with the modular sill when the door is in an open position.

18. The method according to claim 14, further comprising forming the extension top plate with a flat top surface.

19. The method according to claim 14, further comprising forming the extension top plate of aluminum and forming the extension base plate of stainless steel.

* * * * *